US011049635B2

(12) United States Patent
Matsui

(10) Patent No.: US 11,049,635 B2
(45) Date of Patent: Jun. 29, 2021

(54) SOLENOID

(71) Applicant: NACHI-FUJIKOSHI CORP., Tokyo (JP)

(72) Inventor: Takeshi Matsui, Toyama (JP)

(73) Assignee: NACHI-FUJIKOSHI CORP., Tokyo (JP)

( * ) Notice: Subject to any disclaimer, the term of this patent is extended or adjusted under 35 U.S.C. 154(b) by 382 days.

(21) Appl. No.: 16/081,681

(22) PCT Filed: Mar. 3, 2016

(86) PCT No.: PCT/JP2016/056601

§ 371 (c)(1),
(2) Date: Dec. 20, 2018

(87) PCT Pub. No.: WO2017/149726

PCT Pub. Date: Sep. 8, 2017

(65) Prior Publication Data

US 2019/0122797 A1 Apr. 25, 2019

(51) Int. Cl.
*H01F 7/00* (2006.01)
*H01F 7/122* (2006.01)
(Continued)

(52) U.S. Cl.
CPC ..... *H01F 7/122* (2013.01); *H01F 7/081* (2013.01); *H01F 7/16* (2013.01); *H01F 7/1615* (2013.01);
(Continued)

(58) Field of Classification Search
CPC . H01F 7/16; H01F 7/18; H01F 13/003; A61B 34/20; A61B 50/3001;
(Continued)

(56) References Cited

U.S. PATENT DOCUMENTS 3,814,376 A * 6/1974 Reinicke ..... F16K 31/082 251/65
4,127,835 A 11/1978 Knutson
(Continued)

FOREIGN PATENT DOCUMENTS

EP 1225609 A2 7/2002
JP S59-501928 A 11/1984
(Continued)

OTHER PUBLICATIONS

International Search Report issued (in English and Japanese) issued in PCT/JP2016/056601, dated May 17, 2016; ISA/JP.
(Continued)

*Primary Examiner* — Shawki S Ismail
*Assistant Examiner* — Lisa N Homza
(74) *Attorney, Agent, or Firm* — Harness, Dickey & Pierce, P.L.C.

(57) ABSTRACT

Provided according to the present invention is a solenoid with a built-in permanent magnet, with which it is possible to suppress an increase in the amount of magnetic flux that passes through the chuck part, even when the magnetic flux generated by a coil is greater than the magnetic flux of the magnet, and to reliably reduce attraction force. In this solenoid, a permanent magnet and a coil are both built into a cylindrical case having an opening part; the permanent magnet and the coil are both separated and arranged inside the case; a ring member is arranged adjacent to the permanent magnet; a movable iron core is inserted inside the coil; and between the movable iron core and the coil, a metal coil cover is provided so as to cover the coil. The distance d between the case inner wall and the ring member can also be in the range of 0.1-0.3 mm.

2 Claims, 4 Drawing Sheets

(51) Int. Cl.

| | |
|---|---|
| ***H01F 7/16*** | (2006.01) |
| ***H01F 7/08*** | (2006.01) |
| *H01F 7/02* | (2006.01) |
| *H01F 7/18* | (2006.01) |

(52) U.S. Cl.
CPC ..... *H01F 7/02* (2013.01); *H01F 2007/083* (2013.01); *H01F 2007/1894* (2013.01)

(58) Field of Classification Search
CPC ..... A61B 2034/2051; A61M 5/3202; A61M 2205/0272; A61M 2205/6054; H05K 9/0075
USPC ..... 335/229
See application file for complete search history.

(56) References Cited

U.S. PATENT DOCUMENTS

| | | | | |
|---|---|---|---|---|
| 4,419,643 | A | 12/1983 | Ojima et al. | |
| 4,660,010 | A * | 4/1987 | Burton | H01F 7/145 335/228 |
| 5,190,223 | A * | 3/1993 | Mesenich | F02M 51/005 239/585.5 |
| 6,816,048 | B2 * | 11/2004 | Morita | H01F 7/1615 218/154 |
| 8,581,682 | B2 * | 11/2013 | Patino | H01H 51/2209 335/229 |
| 10,655,748 | B2 * | 5/2020 | Ho | F16K 31/082 |
| 2017/0314700 | A1 * | 11/2017 | Iwanaga | F16K 27/048 |

FOREIGN PATENT DOCUMENTS

| | | | |
|---|---|---|---|
| JP | S64-006573 | A | 1/1989 |
| JP | H10223432 | A | 8/1998 |
| JP | 2002-289430 | A | 10/2002 |
| WO | WO-2008/075640 | A1 | 6/2008 |

OTHER PUBLICATIONS

Office Action dated Jun. 26, 2019 in corresponding Japanese Patent Application No. 2018-502452.
Extended European Search Report dated Jul. 4, 2019 in corresponding European Patent Application No. 16892566.

* cited by examiner

SOLENOID

CROSS REFERENCE TO RELATED APPLICATIONS

This application is a U.S. National Phase Application under 35 U.S.C. 371 of International Application No. PCT/JP2016/056601 filed on Mar. 3, 2016. The entire disclosure of the above application is incorporated herein by reference.

TECHNICAL FIELD

The present invention relates to a solenoid provided with both a permanent magnet and a coil.

BACKGROUND ART

Conventionally, in a solenoid provided with both a permanent magnet and a coil, when the coil is not energized, magnetic flux generated by the permanent magnet passes through a portion (attraction portion) where a movable iron core and another part are attracted to each other, so that attraction force is generated. When the coil is energized, magnetic flux generated by the coil flows so as to counteract the magnetic flux generated by the magnet. As a result, since the magnetic flux (generated by the magnet) passing through the attraction portion is reduced, the attraction force decreases and finally can be canceled.

For example, PATENT LITERATURE 1 discloses a solenoid provided with both a permanent magnet and a coil. The solenoid according to the literature has a structure in which the permanent magnet is disposed in a space surrounded by a movable iron core and a fixed iron core. Therefore, a magnetic field (magnetic path) generated by energizing the coil does not have a direct effect on the permanent magnet. Further, the literature explains that the permanent magnet is not demagnetized even in a release operation of the solenoid, so that a long life of the solenoid can be ensured.

CITATION LIST

Patent Literature

PATENT LITERATURE 1: JP 2002-289430 A

SUMMARY OF INVENTION

Technical Problem

However, in the solenoid disclosed in PATENT LITERATURE 1, when energization of the coil is started in the release operation, magnetic flux BC generated in the coil flows against magnetic flux BM generated by the magnet (see FIG. 5 in the literature). Then, the amount of magnetic flux generated by the permanent magnet that passes through an attraction portion (a portion where a disk-shaped steel plate 6 and a protrusion 4 are in contact with each other shown in FIG. 5 of the literature) is reduced, and attraction force of the movable iron core decreases.

After that, if the coil generates such an amount of magnetic flux that exactly counteracts the magnetic flux generated by the permanent magnet, the magnetic flux passing through the attraction portion is eliminated, so that the attraction force of the movable iron core almost disappears finally. However, if the magnetic flux generated by energizing the coil is sufficiently greater than the magnetic flux generated by the permanent magnet, the magnetic flux passing through the attraction portion is switched from the magnetic flux generated by the permanent magnet to the magnetic flux generated by the energization of the coil, and therefore there has been a problem that the generation of the attraction force is started again. In other words, there has been a problem that the release operation of the solenoid becomes incomplete depending on the amount of magnetic flux generated by the energization of the coil.

Therefore, the present invention has been made for solving the above problems, and an object thereof is to provide a solenoid which can reliably perform a release operation by suppressing increase in amount of magnetic flux passing through an attraction portion to decrease attraction force of a movable iron core even when magnetic flux generated by the energization of a coil is greater than magnetic flux generated by a magnet.

Solution to Problem

In order to solve the problems described above, according to the present invention, there is provided a solenoid in which a permanent magnet and a coil are both built in a cylindrical case having an opening, a ring member is disposed in close contact with the permanent magnet, a movable iron core is inserted and provided in the coil, and a metallic coil cover is disposed between the movable iron core and the coil so as to cover the whole coil. Further, the distance between an inner wall of the case and the ring member may be set in the range of 0.1 mm to 0.3 mm.

Advantageous Effects of Invention

According to the solenoid of the present invention, in a type of solenoid which is provided with both a permanent magnet and a coil, the coil is disposed in a case so that the whole coil is covered with a metallic coil cover. With this configuration, a magnetic path through which magnetic flux generated by the permanent magnet passes, and a magnetic path through which magnetic flux generated by energizing the coil passes are separately and independently generated. Further, the solenoid is configured so that a portion (attraction portion) where a movable iron core and a ring member are in contact with each other does not exist in the middle of the magnetic paths. Accordingly, even when magnetic flux generated by the coil is greater than magnetic flux generated by the magnet, it is possible to achieve a quick release operation of the solenoid by suppressing increase in amount of magnetic flux passing through the attraction portion to reliably decrease attraction force of the movable iron core.

Figure 1A:
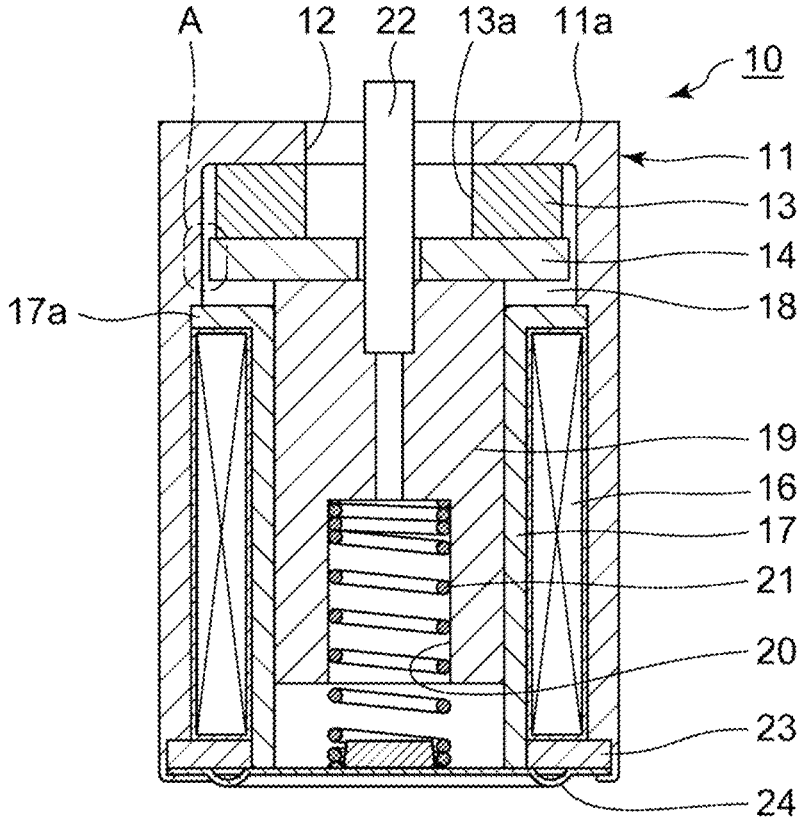
FIG. 1A is a longitudinal sectional view (during non-energization) of a solenoid 10 which is one example of an embodiment of the present invention.

of the flows of the magnetic paths 26 and 27 during energization of the solenoid 10 shown in FIG. 1A.

Figure 4:
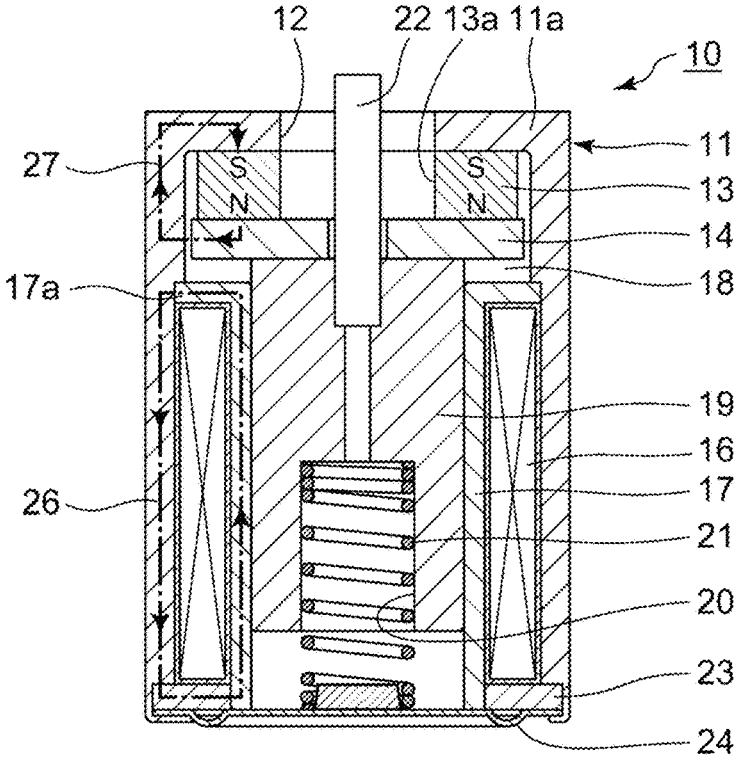
FIG. 4 is an explanatory view (when a ring member 14 and a movable iron core 19 are attracted to each other) of flows of magnetic paths 26 and 27 during energization of the solenoid 10 shown in FIG. 1A.
Figure 6:
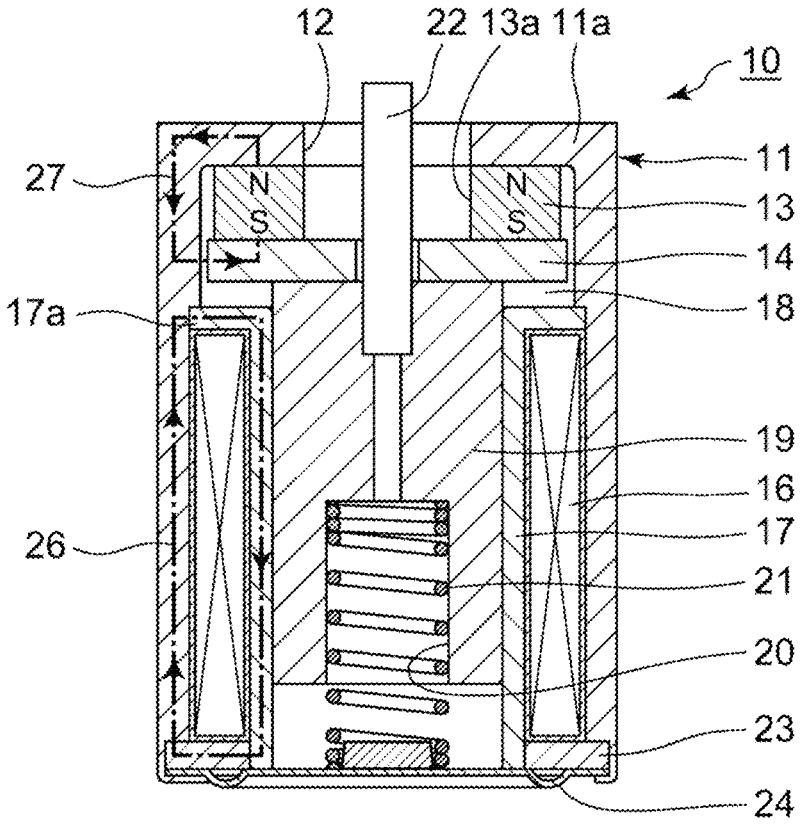

FIG. 6 is an explanatory view of a different embodiment where the flow of the magnetic path is in an opposite direction to the flow of the magnetic path during energization of the solenoid 10 shown in FIG. 4.

DESCRIPTION OF EMBODIMENTS

Figure 1B:
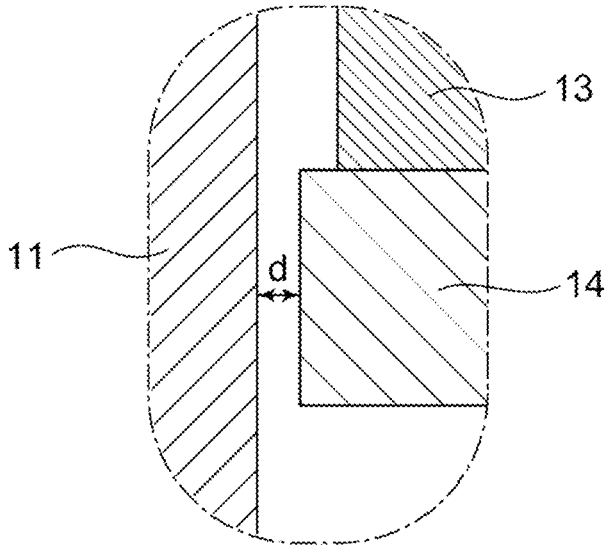
FIG. 1B is an enlarged view of an A part of FIG. 1A.

Hereinafter, a specific embodiment is shown to describe a solenoid according to the present invention in detail with reference to the accompanying drawings. FIG. 1A is a longitudinal sectional view of a solenoid 10 according to the present invention. FIG. 1B is an enlarged view of an A part shown in FIG. 1A.

The solenoid 10 according to the present invention is of a type in which a permanent magnet 13 and a coil 16 are disposed in a cylindrical case 11 as shown in FIG. 1A. A circular opening 12 is formed in an end face 11*a* (on an upper side in FIG. 1A) of the case 11. The permanent magnet 13 of a cylindrical shape having a hole 13*a* is provided inside the case 11 in such a manner as to closely contact a back side (inner side) of the end face 11*a* of the case 11. Moreover, the hole 13*a* of the permanent magnet 13 and the opening 12 of the case 11 are arranged in such a positional relation as to be concentric with each other as shown in FIG. 1A.

It should be noted that a clearance may be provided between the permanent magnet 13 and an inner wall surface of the case 11 as shown in FIG. 1A, and the clearance may be filled with a nonmagnetic material such as resin. The configurations of the permanent magnet and the coil constituting the solenoid of the present invention will be described below in detail.

A ring member 14 is disposed on the permanent magnet 13 built in the case 11 so as to be in close contact with a lower surface (on a lower side in FIG. 1A) of the permanent magnet 13. The inside diameter side of the ring member 14 is disposed so as to be concentric with the hole 13*a* of the permanent magnet 13 as shown in FIG. 1A.

Furthermore, as shown in FIG. 1B, the outside diameter side of the ring member 14 is disposed inside the case 11 at a given distanced from the inner side (inner wall) of the case 11. The distance d is in the range of 0.1 mm to 0.3 mm due to the relation with a magnetic path described below.

Figure 2:
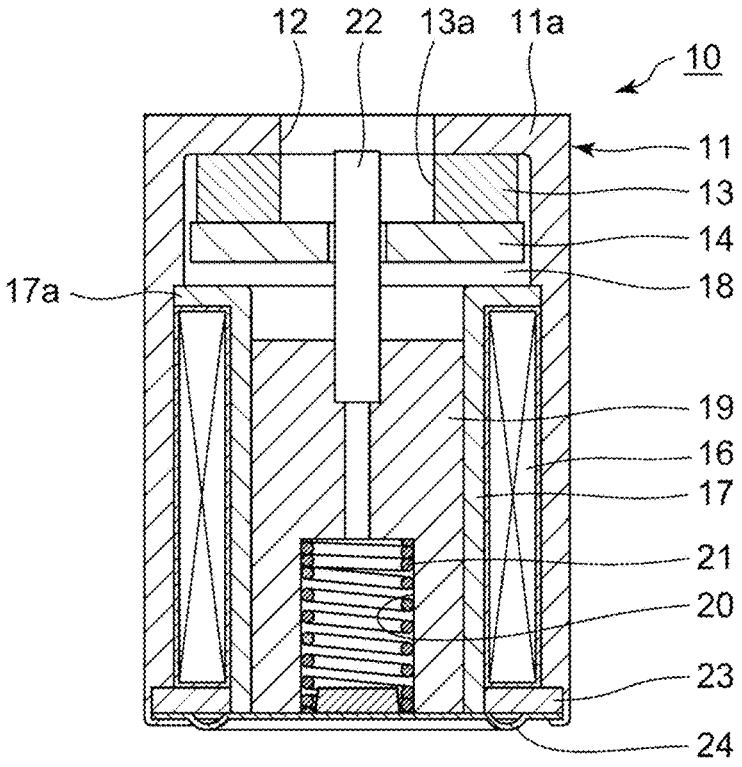
FIG. 2 is an operation explaining view (during energization) of the solenoid 10 shown in FIG. 1A.

A movable iron core (plunger) 19 is inserted in the cylindrically shaped coil (electromagnetic coil) 16 built in the case 11, and the movable iron core 19 can be moved in an axial direction (up-down direction in FIG. 1A) by electromagnetic force generated by energization of the coil 16 (see FIGS. 1A and 2). A recess 20 is provided in the axial direction on the one end side (lower side of FIG. 1A) of the movable iron core 19, and a spring 21 is attached to the inside of the recess 20. The one end side (upper side in FIG. 1A) of the spring 21 is fitted in the recess 20, and the other end side (lower side in FIG. 1A) of the spring 21 is fitted and thus fixed to a protrusion formed in a cap member 24 of the solenoid 10.

Moreover, a shaft 22 is provided on the other end side (upper side of FIG. 1A) of the movable iron core 19, namely, on the side opposite to the recess 20. When the movable iron core moves in the axial direction (up-down direction in FIG. 1A), the shaft 22 can move through the opening 12 of the case 11, the hole 13*a* of the permanent magnet 13, and the inside diameter side of the ring member 14 accordingly.

In addition, a metallic coil cover 17 is disposed between the coil 16 and the movable iron core 19 so as to cover the whole coil 16. The coil cover 17 has a flange 17*a* on its one end side. The coil cover 17 is fixed to the case 11 in such a manner that the flange 17*a* is fitted in the inner wall surface of the case 11 while covering the one end side (upper side in FIG. 1A) of the coil 16. Further, a clearance 18 of a given distance is formed in the axial direction of the solenoid 10 between an upper surface (upper side of FIG. 1A) of the flange 17*a* and a lower surface (lower side of FIG. 1A) of the ring member 14. The other end side (lower side of FIG. 1A) of the coil 16 is fixed by caulking the cap member 24 and the case 11 via a ring member 23. It should be noted that the clearance 18 may be filled with a nonmagnetic material such as resin.

Figure 3:
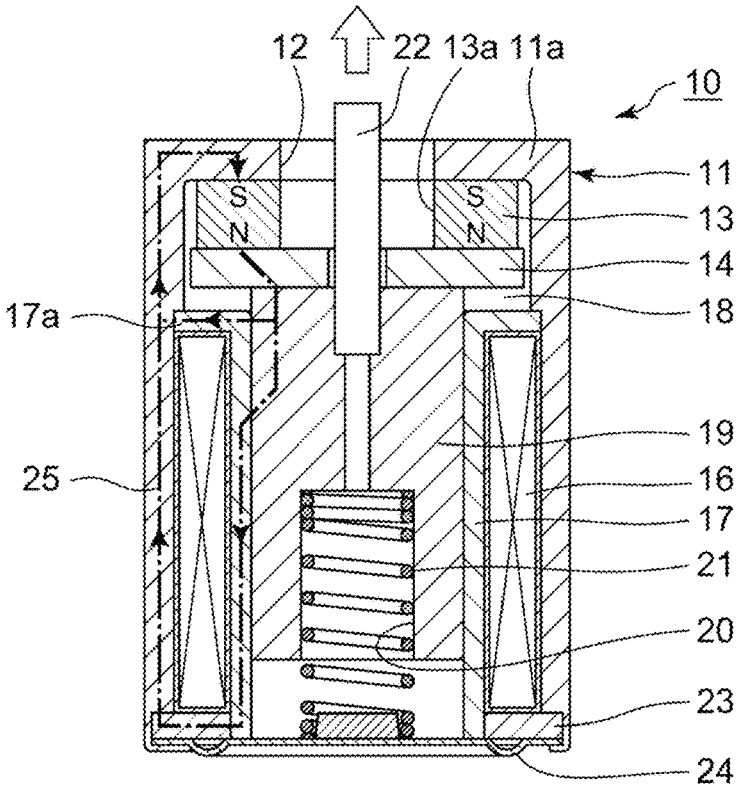
FIG. 3 is an explanatory view of a flow of a magnetic path 25 during non-energization of the solenoid 10 shown in FIG. 1A.

The solenoid 10 according to the present embodiment is basically configured as above. Next, its operation and effects are described with reference to the drawings. When the coil 16 in the solenoid 10 shown in FIG. 1A is not energized, the respective parts of the solenoid 10 such as the movable iron core 19 and the shaft 22 are arranged as shown in FIG. 3.

That is, the movable iron core 19 is attracted to the permanent magnet 13 side (upper side of FIG. 3) due to the elastic force of the spring 21 attached to the recess 20 and the magnetic force of the permanent magnet 13, and then comes into contact with the ring member 14. In this instance, if the north pole of the permanent magnet 13 is located on the ring member 14 side (lower side of FIG. 3) and the south pole thereof is located on the opening 12 side (upper side of FIG. 3) of the case 11, the flow of magnetic flux generated (by the permanent magnet 13) in the solenoid 10 is formed as a first magnetic path 25 shown in FIG. 3.

When the coil 16 in the solenoid 10 shown in FIG. 1A is energized, a magnetic path generated in the solenoid 10 is formed as shown in FIG. 4. That is, if the coil 16 is energized as shown in FIG. 4 (namely, if the coil 16 is excited so as to have magnetic flux in an opposite direction to the magnetic flux of the permanent magnet 13), the magnetic flux of the coil 16 flows in a second magnetic path 26 which is present in the middle of the first magnetic path 25 shown in FIG. 3. Since the second magnetic path 26 is located in the middle of the first magnetic path 25, if the magnetic flux of the coil 16 circles in the second magnetic path 26 by the excitation of the coil 16, the first magnetic path 25 is magnetically saturated, and thus increases in magnetoresistance.

As a result, the magnetic flux of the permanent magnet 13 starts to pass in a third magnetic path 27, rather than the first magnetic path 25 which is high in magnetoresistance, via the distance d between the outside diameter side of the ring member 14 and the inner side (inner wall) of the case 11. Accordingly, the magnetic flux passing through a place where the ring member 14 and the movable iron core 19 are attracted to each other is reduced. Consequently, the movable iron core 19 and the ring member 14 are separated from each other as shown in FIG. 5, and the movable iron core 19 can be moved to a lower position by slight external force (in the direction of an arrow in FIG. 5).

Figure 5:
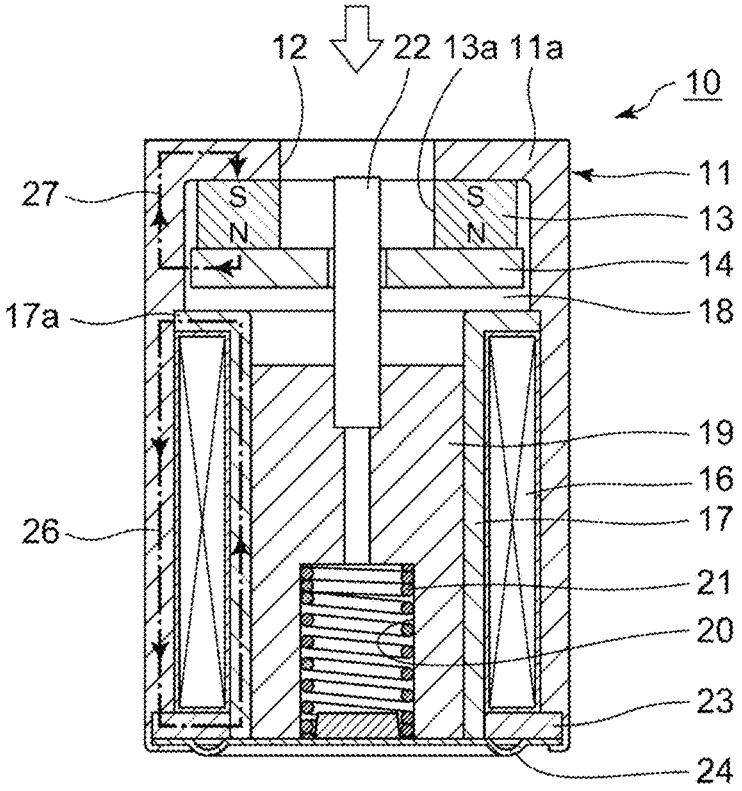
FIG. 5 is an explanatory view (when the ring member 14 and the movable iron core 19 are separated from each other)

It should be noted that the solenoid according to the present invention brings about the advantageous effects of the present invention in the case of a state where the direction of the magnetic flux generated by the permanent magnet is opposite to the direction of the magnetic flux generated by the energization of the coil as shown in FIGS. 4 and 5. Moreover, similar advantageous effects to those of the present invention are brought about even in the case where the direction of the magnetic flux generated by the permanent magnet and the direction of the magnetic flux generated by the energization of the coil are made opposite as shown in FIG. 6 to those shown in FIGS. 4 and 5.

Contrary to this, it goes without saying that the advantageous effects of the present invention are not exerted if the permanent magnet is disposed in an opposite direction to that shown in FIGS. 4 to 6, or if the direction of applying current in the coil or the winding direction of a wire rod such as a copper wire wound around the coil is reversed so that only the direction of magnetic flux is opposite to that shown in FIGS. 4 to 6.

REFERENCE SIGNS LIST

10: Solenoid
11: Case
12: Opening of case 11
13: Permanent magnet
14: Ring member
16: Coil
17: Coil cover
19: Movable iron core
d: Distance between inner wall of case 11 and outer side of ring member 14

The invention claimed is:

1. A solenoid comprising: a cylindrical case having an opening; and a permanent magnet and a coil both built into the cylindrical case, wherein the permanent magnet and the coil are arranged separately in an axial direction in the case so that the permanent magnet is located nearer to the opening than the coil is, a first ring member defining a center hole and an outer periphery is arranged adjacently to the permanent magnet on its far side from the opening to form a predetermined distance between the outer periphery of the first ring member and an inner wall of the case, a movable iron core is inserted in the coil so as to be arranged on a far side of the first ring member from the opening, a diameter of the iron core is larger than a diameter of the center hole of the first ring member, a metallic coil cover having a flange on its end facing the first ring member is provided between the movable iron core and the coil, and the coil cover and a second ring member which is arranged on an opposite side of the coil to the flange are fixed to the case so as to completely cover the coil, thereby a magnetic path is formed through the first ring member, the movable iron core, the coil cover, the second ring member, the case and the flange by the permanent magnet during non-energization of the coil.

2. The solenoid according to claim 1, wherein the predetermined distance between the inner wall of the case and the outer periphery of the first ring member is in a range of 0.1 mm to 0.3 mm.

* * * * *